US006691370B2

(12) United States Patent
Tatara

(10) Patent No.: US 6,691,370 B2
(45) Date of Patent: Feb. 17, 2004

(54) CONTINUOUS DOOR HINGE WITH MULTI-PLASTIC BEARINGS

(75) Inventor: Stanley R. Tatara, Akron, NY (US)

(73) Assignee: Markar Aritectural Products, Inc., Lancaster, NY (US)

( * ) Notice: Subject to any disclaimer, the term of this patent is extended or adjusted under 35 U.S.C. 154(b) by 0 days.

(21) Appl. No.: 10/122,000

(22) Filed: Apr. 15, 2002

(65) Prior Publication Data

US 2003/0200628 A1 Oct. 30, 2003

(51) Int. Cl.[7] ..... E05D 1/04
(52) U.S. Cl. ..... 16/355; 16/260; 16/221
(58) Field of Search ..... 16/355, 260, 221

(56) References Cited

U.S. PATENT DOCUMENTS 1,144,090 A * 6/1915 Anderson ..... 16/276
1,731,424 A * 10/1929 Kohn ..... 403/119
1,824,451 A * 9/1931 Soss ..... 16/355
2,302,661 A * 11/1942 Benson ..... 16/267
3,118,702 A * 1/1964 Kale et al. ..... 296/106
3,402,422 A * 9/1968 Baer ..... 16/366
4,475,268 A * 10/1984 Labelle ..... 16/355
4,976,008 A * 12/1990 Baer ..... 16/354
4,999,878 A * 3/1991 Baer ..... 16/354
5,062,181 A * 11/1991 Bobrowski et al. ..... 16/354

FOREIGN PATENT DOCUMENTS

EP 462740 A1 * 12/1991 ..... E05D/1/04

* cited by examiner

*Primary Examiner*—Anthony Knight
*Assistant Examiner*—Michael J. Kyle

(57) ABSTRACT

The invention relates to a unique door hinge which does not employ pin receiving knuckles which are normally us in more conventional hinges. The unique hinge, provides two hinge leafs, the first of which has a flat web which terminates at an open end loop which is coextensive with the web and defines a space for matingly receiving a head portion which is at the termination of the web of the second leaf. The head portion is rotatable within the loop portion and is segmented by longitudinally spaced spaces for receiving plastic bearings which facilitate rotation of the hinge and support the movable hinge leaf relative to the fixed hinge leaf of a normally mounted door hinge.

10 Claims, 3 Drawing Sheets

CONTINUOUS DOOR HINGE WITH MULTI-PLASTIC BEARINGS

BACKGROUND OF THE INVENTION

The invention relates to hinges, especially piano type hinges which are used to mount a swinging door to a fixed door frame. Such doors may be made of any suitable material, such as wood plastic, or metal, and the hinges may made of any appropriate material, including plastic or metal, such as aluminum, steel or brass.

More particularly, the invention is a unique continuous door hinge which is more easily manufactured and installed, because it does not have the many intermeshing pin receiving knuckles which are provided on more conventional door hinges. This unique door hinge is readily adapted to doors of different lengths. Further, it employs a number of relatively small; plastic bearings which act to facilitate rotation and support of a door which is attach to the hinge.

DESCRIPTION OF THE DRAWINGS

The following description of the invention will be better understood by having reference to the accompanying ring, wherein.

DETAILED DESCRIPTION OF THE DRAWING

Figure 1:
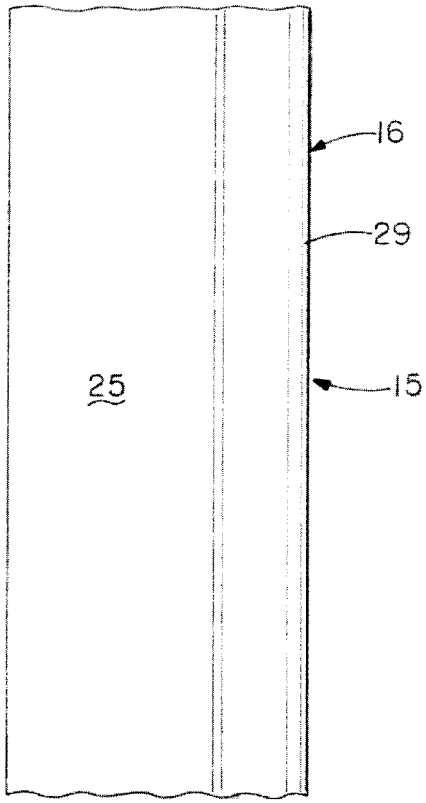
FIG. 1 is a side view of a portion of the hinge leaf which is designed for attachment to a fixed door frame.

With general reference to the drawing for like parts and particular reference to FIGS. 1–7, there is shown a piano-type continuous, metal or hinge 15 which, in some cases, can be composed of any durable plastic material. The door hinge is comprised of two coextensive, metal leafs 16 and 17 which are mounted together for relative rotation, the first leaf 16 hereinafter referred to as the door leaf because it is secured to a metal door 18 by any suitable fastening means

19, e.g. metal screws, and the second leaf 17 hereinafter referred to the frame leaf because it is secured to an adjacent fix metal door frame 20 and integrally formed door stop 21, by similar fastening means 19. The door 18 and attached door frame 20, in some cases, can be composed of plastic or wood.

A number of similar bearings 22, composed of any appropriate plastic material, such as nylon, are longitudinally spaced on the frame leaf 17 for coaction with the door leaf 16, to facilitate relative rotation of the hinge leaves 16 and 17.

Figure 3:
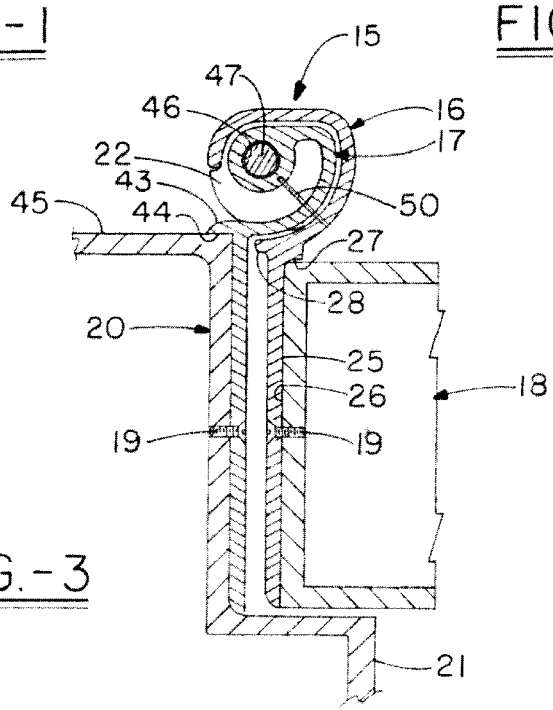
FIG. 3 is a cross section of the hinge viewed from the line 3—3 of FIG. 2, but rotated 90 degrees to the right, and which includes portions of a door and door frame.
Figure 4:
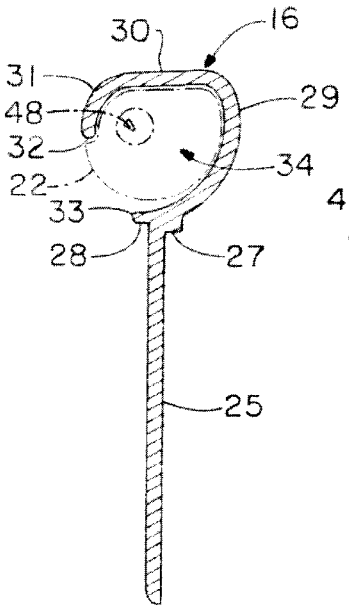
FIG. 4 is a cross section of the hinge leaf which is attach to the door.
Figure 11:
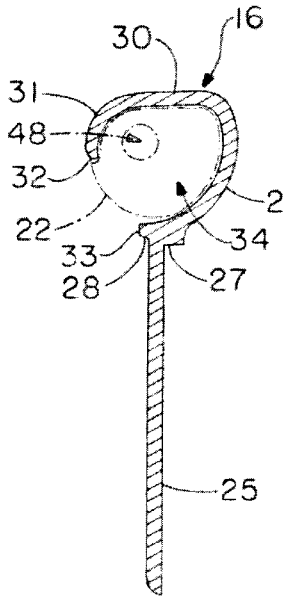
FIG. 11 is a cross section of the door leaf of the second hinge, the door leafs of the first and second embodiments of the invention being identical in structure.

With particular reference to FIGS. 4 and 11, the door leaf 16 comprises a flat web 25 which is designed to be secured to an adjacent edge 26 (FIG. 3) of the door 18. The web 25 is coextensive with the thickness of the door 18 and terminates at a pair of slightly offset coplanar abutments 27 and 28 which in parallel planes that are normal to the plane of the web 25. The abutments 27 and 28 are formed in a first, arcuate wall segment 29 which curves in a direction away from the abutments 27 and 28 and the web 25, and terminates at a flat wall segment 30 which is normal to the plane of the web 25. The flat wall segment 30 terminates at a second, shorter arcuate wall segment 31 which curves back towards the web 25 and terminates at a free end 32 which is in spaced arcuate relation from a free end 33 of the first, longer arcuate wall segment 29, which free end 33 is adjacent the abutment 28 that extends from the web 25 in opposed relation from the abutment 27 which is designed to abut the door edge 26. The wall segments 29–31 are coextensive with the flat web 25, a form an open ended loop a space 34 therein for rotatably and slidably receiving an adjacent, matingly shaped, coextensive head portion 35 of the frame leaf 17.

Figure 5:
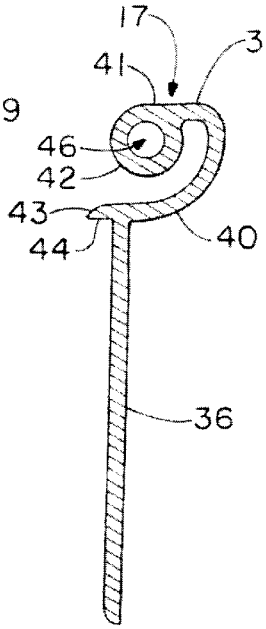
FIG. 5 is a cross section of the hinge leaf which is attach to the door frame.
Figure 6:
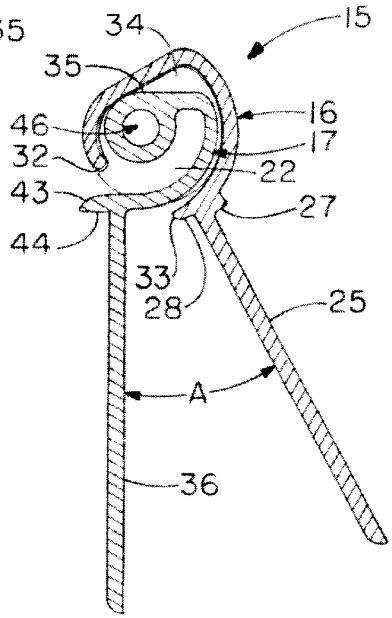
FIG. 6 is a cross sectional view which is similar to FIG. 3, but designed to show the included angle between the two leafs when the hinge is in an open position.
Figure 7:
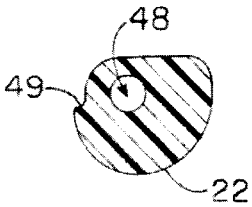
FIG. 7 is a cross section of a typical plastic bearing used in connection with the hinge.
Figure 8:
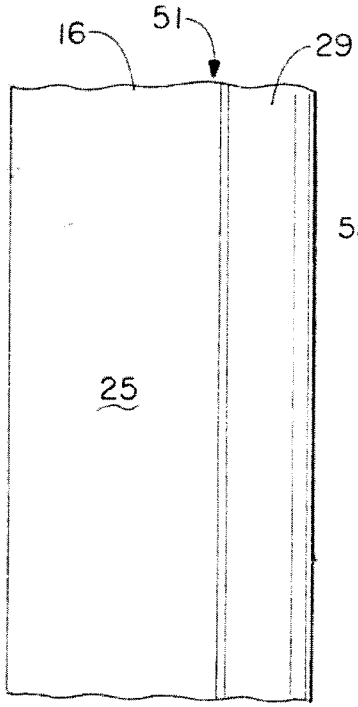
FIG. 8 is similar to FIG. 1, but of a second embodiment of the hinge of the invention.
Figure 12:
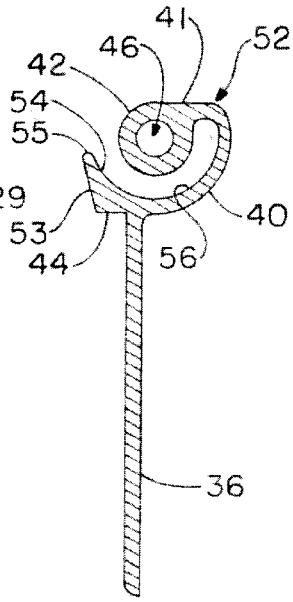
FIG. 12 is a cross section of the frame leaf of the second hinge, a comparison of FIGS. 12 and 5 revealing that the different frame leafs have some common structure.
Figure 13:
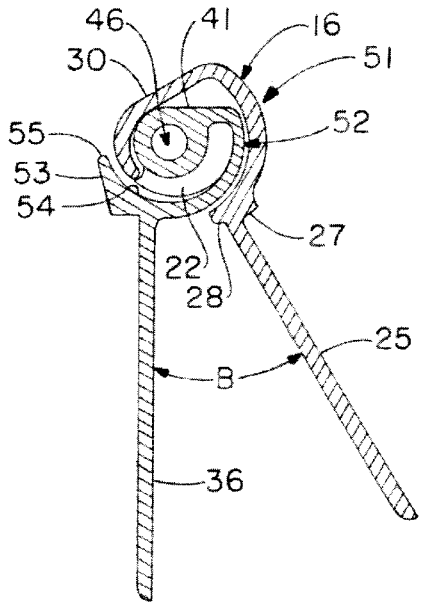
FIG. 13 is similar to FIG. 6, but of the second hinge.

With particular reference to FIGS. 5 and 12, the frame leaf 17 also comprises a flat web 36 which is slightly longer than the correspondingly measured door leaf web 25, to provide clearance between the door 18 and adjacent door stop 21 of the fixed member or frame 20. The frame leaf web 36 terminates at the head portion 35 which is coextensive with the frame leaf web 36.

The head portion 35 is longitudinally divided into a number of similar head wall portions 37 which are separated by spaces 38 for matingly receiving the plastic bearings 22 which are about 0.625 inches wide and longitudinally spaced about 3.375 inches apart. Each one of the head wall portions 37 includes, I) a part of an arcuate wall portion 40, II) a flat wall portion 41, and III) a hollow cylindric wall portion 42. The arcuate wall portions 40 curve in a direction away from the frame leaf web 36 and are matingly curved for receipt in closely spaced relationship within and against the first arcuate wall segment 29 of the door leaf 16. The arcuate wall portions 40 have a free end 4 which projects beyond the frame leaf web 36 to form therein, an abutment 44 which is normal to the plane of the frame leaf web 36 and which is designed to abut an adjacent edge 4 (FIG. 3) of the door frame 20. The arcuate wall portions 4 terminate at the flat planar wall portions 41 which are in a plane that is normal to the plane of the frame leaf web 36, and which are designed for mating position within and against the flat wall segment 30. The flat wall portions 41 terminate at the hollow cylindrical portions 42 which project from the flat wall portions 41 back towards the frame leaf web 36 and include axially aligned bores 46 which are design to receive a pivot pin 47 (FIG. 3) which is coextensive with the hinge leafs 16 and 17.

Figure 10:
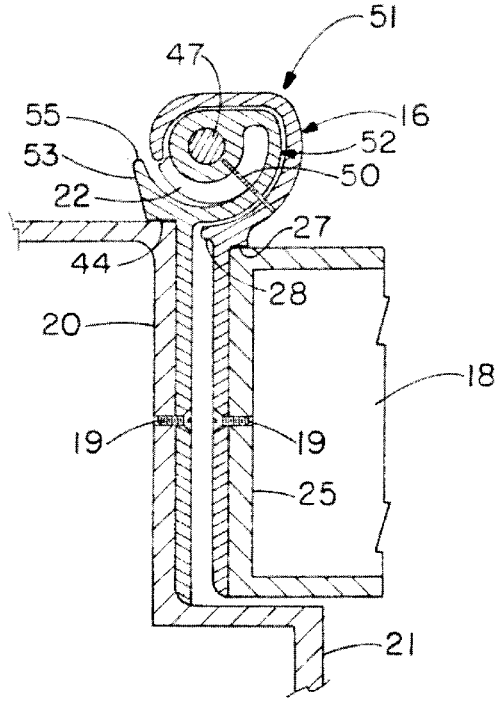
FIG. 10 is a cross sectional view similar to FIG. 3, but of the second hinge.

The free end 33 of the door leaf 16, as best seen in FIGS. 3 and 10, acts a spacer or bumper for engaging the adjacent frame leaf web 36 to maintain the two webs 25 and 36 in predetermined closely spaced apart relation, when the hinge 15 is closed where the webs 25 and 36 of the two hinge leafs 16 and 17 are in side-by-side relation.

The plastic bearings 22 (FIG. 7) are each provided with a longitudinal bore 48 for receiving the pivot pin 47, when the bearings 21 are assembled with the two hinge leafs 16 and 17. A study of the drawing reveals that each one of the plastic bearings 22 is shaped to fit snugly in the space 34 defined by the wall segments 29–31 of the door leafs 16 of both embodiments of the invention. Further, each one of the plastic bearings 22 is provided with a combination seat and abutment 49 in, and against which, the free end 32 of the second arcuate wall segment 31, rests and abuts.

A set screw 50 (FIGS. 3 and 10) is used at the opposing ends and middle of the hinge 15 to secure the door leaf 16 and three of the the plastic bearings 22 to the pivot pin 47, whereby the plastic bearings act to hold the frame leaf 17, in position, and prevent it from moving longitudinally of the door leaf 16. The maximum included angle A (FIG. 4) between the two hinge leaf webs 25 and 36 is 180 degrees plus 1–3 degrees, when the hinge 15 is fully open.

With particular reference to FIGS. 8–13, the second embodiment or door hinge 51 has many of the structural components of the first embodiment or hinge 15. For example, a comparison of FIGS. 4 and 11 reveals that the door leafs 16 of the first and second hinges 15 and 51 are identical. Moreover, the frame leafs 17 and 52 of the first and second hinges 15 and 51 are identical, except that the frame leaf 52 of the second hinge 51, has a coextensive flange 53 which is disposed at the free end 43 of the arcuate portions 40, and extends therefrom in a direction away from the frame leaf web 36.

Figure 2:
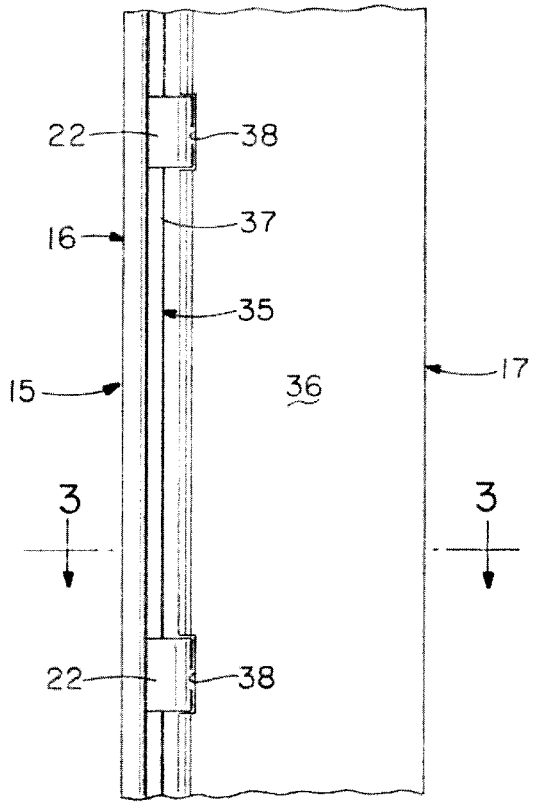
FIG. 2 is a side view of a portion of the other hinge leaf which is designed for attachment to a swinging door which is mount on the fixed door frame.
Figure 9:
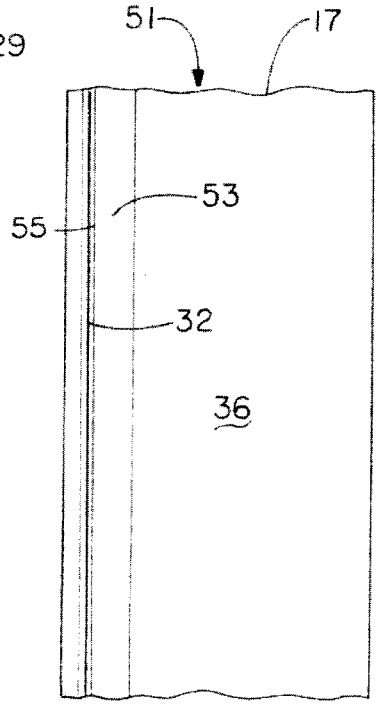
FIG. 9 is similar to FIG. 2, but of the second hinge.

The flange 5 has a curved inner surface 54, which terminates at a free outer end 55, and which is a continuation of the adjacent inner curved surfaces 56 of the arcuate wall portions 40. The free end 55 (FIG. 13) of the flange 53 extends to the adjacent free end 32 of the door leaf 16, and contacts the flat wall segment 30, to restrict the maximum included angle B between two leaf webs 25 and 36 of the second hinge 51 to about 127 degrees, when the hinge 51 is fully open. A comparison of FIGS. 2 and 9 shows graphically how the addition of the flange 53 of the second hinge 51 covers and hides the appearance of the plastic bearings 22 to produce a more aesthetically pleasing appearance of the second hinge 51. A similar set screw 50 is also used to hold the components of the second hinge 51 together.

Thus, there has been described tow embodiments of a hinge which is more pleasing, in appearance, is easier to manufacture and assemble, and is easily accommodated to doors of different lengths. The plastic bearings not only facilitate rotation of the hinge, but literally support the door leaf and attached door. When the frame leaf is secured to a fixed frame of door jamb.

What is claimed is:

1. A hinge, comprising:

a) a first leaf which is coextensive with the hinge and has a flat web which is coextensive with the teal for attachment to a movable member, the web terminating at a partially enclosed loop portion which is continuous throughout its length, coextensive with the web; and has a coextensive opening therein;

b) a second leaf which is coextensive with the first leaf and has a flat web which is coextensive with the second leaf for attachment to a fixed member, the web of the second leaf terminating at a head portion which is rotatably and slidably received in the loop portion through the opening therein, the head portion being coextensive with the loop portion and divided longitudinally into a number of elongated hollow cylindrical wall portions with comparatively short spaces between them, the cylindrical wall portions having axially aligned bores for receiving a pivot pin;

c) a continuous pivot pin extending through the bores and spaces between the cylindrical wall portions, the pivot pin being coextensive with the leafs;

d) a plastic bearing disposed in, and longitudinal filling, each of the spaces between the cylindrical wall portions, each bearing having a bore through which the pivot pin passes, the bores of the bearings being axially aligned with the bores of the cylindrical wall portions of the head portion, each bearing shaped to fit snugly in the loop portion of the first leaf; the bearings designed to hold the loop portion in spaced relation from the head portion, at least when the hinge is closed where the leafs are side-by-side in closest spaced relation, to facilitate relative rotation of the leafs, and;

e) means coacting with the first leaf, at least two plastic bearings, and the pivot pin for securing the two leafs, bearings and pivot pin together to prevent relative axial movement between the leafs.

2. The hinge of claim 1, wherein the loop portion of the first leaf includes:

f) a first arcuate wall segment which curves in a direction away from the web of the first leaf;

g) a flat wall segment extending from the first arcuate wall segment, the flat wall segment being in a plane that is normal to the plane of the web of the first leaf; and h) a second arcuate wall segment which curves from the flat wall segment in a direction back towards the web of the first leaf, the second arcuate wall segment having a first free end which is in spaced relation from a second free end of the first arcuate wall segment, the second free end extending beyond the side of the web of the first leaf closer the first end.

3. The hinge of claim 2, wherein each one of the hollow cylindrical wall portions includes;

j) a flat wall portion from which the cylindrical wall portion extends in a direction towards the web of the second leaf, the flat wall portion being in a plane that is normal to the plane of the web of the second leaf; and k) an arcuate wall portion which curves from the flat wall portion in a direction towards the web of the second leaf, the arcuate wall portion engaging the web of the second leaf and having a free end which extends beyond the web of the second leaf and is coextensive with the web of the second leaf.

4. The hinge of claim 3, which includes;

m) a pair of coplanar abutments formed in the first arcuate segment on either side of the web of the first leaf, the abutments in the first leaf being in a plane which is normal to the plane of the web of the first leaf.

5. The hinge of claim 4, which includes;

n) means coacting between the webs of the leafs for maintaining the webs in predetermined spaced apart relation, when the hinge is closed where the webs are in side-by-side relation.

6. The hinge of claim 5, wherein the means (n) for maintaining the webs apart includes the second free end of the first arcuate segment of the first leaf.

7. The hinge of claim 5, which includes:

o) a flange at the free end of the arcuate wall portion of the second leaf, the flange extending from the free end in a direction away from the web of the second leaf the flange being sufficiently wide to cover the plastic bearings when the hinge is closed where the two webs are in side-by-side relation.

8. A hinge, comprising:

a) a first leaf for attachment to a movable member, the first leaf including the following components which are coextensive with the hinge, namely, I) a first flat web for attachment to the movable member, the first web terminating at a partially enclosed loop portion which, comprises; II) a first arcuate wail segment which curves in a direction away from the first web, the first arcuate wall segment terminating at, III) a generally flat wall segment which is normal to the plane of the first web, the flat wall segment terminating at, IV) a second arcuate segment which curves in a direction back towards the first web, the second arcuate wall segment terminating at a first free end which is in spaced relation from a second free end of the first arcuate wall segment, adjacent the first web, the wall segments forming an open end loop which defines a space therein with an opening between the first and second free ends of the arcuate wall segments;

b) a second leaf for attachment to a fixed member, the second leaf including, V) a separate second flat web for attachment to the fixed member, and VII) a head portion which extends longitudinally of the second web and is coextensive therewith for rotating and sliding reception in the space defined by the loop portion which is formed by the wall segments, the head portion being divided longitudinally into a number of elongated, hollow cylindrical wall portions with comparatively short spaces between them for matingly receiving plastic bearings for facilitating rotation of the hinge, each of the cylindrical wall portions having a bore extending through it for receiving a pivot pin, the bores Of the cylindrical wall portions being axially aligned, each of the cylindrical wall portions including, a flat wall potion from which the cylindrical wall portion extends in a direction towards the second web, the flat wall portion being in a plane that is normal to the plane of the second web, the flat wall portion terminating at an arcuate wall portion which curves from the flat wall portion in a direction towards the second web and terminates at a free end which is adjacent the second web and coextensive with the second web;

c) a pivot pin disposed in the bores and spaces and coextensive with the hinge;

d) a plastic bearing disposed in each one of the bearing receiving spaces in the head portion of the second leaf, each bearing having a similar bore through which the pivot pin passes, the bores of the plastic bearings being axially aligned with the bores of the cylindrical wall portions, each bearing being shaped to fit snugly in the loop portion of the first leaf and having formed therein, a combination seat and abutment for receiving and abutting the adjacent first free end of the second arcuate wall segment of the first leaf; the bearings holding the loop portion in spaced relation from the head portion at least when the hinge is closed where the webs of the leafs are side-by-side in closest spaced relation, and e) means coacting with the first leaf, at least two plastic bearing and the pivot pin for holding the assembly of the first and second leafs, the bearings, and the pivot pin together to prevent relative axial movement of the leafs.

9. The hinge of claim 8, which includes:

f) a flange at the free end of the arcuate wall portion and extending therefrom in a direction away from the web of the send leaf, the flange being sufficiently wide to cover the bearings, when the hinge is closed where the two webs of the hinge are in side-by-side relation, such flange limiting the opening of the hinge to a maximum included angle B between the two webs of about 127 degrees.

10. The hinge of claim 8, which includes means for securing the first and second leafs to a swinging door and a fixed door frame, and wherein the hinge is composed of material selected from the group of metal and plastic.

* * * * *